US006135455A

United States Patent [19]

McNally

[11] Patent Number: 6,135,455

[45] Date of Patent: Oct. 24, 2000

[54] DISK TOSS AND PEG GAME

[76] Inventor: Dennis R. McNally, 11615 James Madison St., Remington, Va. 22734

[21] Appl. No.: 09/109,923

[22] Filed: Jul. 2, 1998

[51] Int. Cl.[7] ..... A63B 67/06

[52] U.S. Cl. ..... 273/338; 273/339; 273/336; 473/588

[58] Field of Search ..... 273/336, 337, 273/338, 339, 350, 285; 473/588, 589, FOR 224, FOR 225

[56] References Cited

U.S. PATENT DOCUMENTS

| | | | |
|---|---|---|---|
| 145,914 | 12/1873 | Smith . | |
| 158,918 | 1/1875 | Dacosta . | |
| 158,991 | 1/1875 | Smith | 273/338 |
| 626,328 | 6/1899 | Kroscher et al. | 273/338 |
| 634,141 | 10/1899 | Hendy . | |
| 659,352 | 10/1900 | Park . | |
| 678,265 | 7/1901 | Low | 473/589 |
| 708,519 | 9/1902 | Bradshaw | 473/589 |
| 793,798 | 7/1905 | McConnell . | |
| 939,580 | 11/1909 | Young . | |
| 1,230,503 | 6/1917 | Miller | 273/336 |
| 1,501,942 | 7/1924 | Carman | 273/339 |
| 1,541,897 | 6/1925 | Buedingen . | |
| 2,012,140 | 8/1935 | Popper | 273/285 |
| 2,432,824 | 12/1947 | Shetler . | |
| 2,506,932 | 5/1950 | McAfee . | |
| 3,312,472 | 4/1967 | Kerr | 473/589 |
| 3,640,535 | 2/1972 | Gendler . | |
| 3,724,122 | 4/1973 | Gillespie, Sr. . | |
| 3,934,879 | 1/1976 | Curtiss et al. . | |
| 4,045,028 | 8/1977 | Dyess . | |
| 4,145,050 | 3/1979 | Sullivan et al. . | |
| 4,157,631 | 6/1979 | Kifferstein et al. . | |
| 4,203,592 | 5/1980 | Quatkemeyer | 273/336 |
| 4,373,734 | 2/1983 | Frank . | |
| 4,643,433 | 2/1987 | Wehby | 273/402 |
| 4,736,955 | 4/1988 | Pollock | 273/336 |
| 4,789,163 | 12/1988 | Warner et al. | 273/336 |
| 4,820,230 | 4/1989 | Richards | 446/48 |
| 4,927,159 | 5/1990 | Morrisey et al. | 273/338 |
| 5,002,286 | 3/1991 | Wade et al. | 273/425 |
| 5,067,727 | 11/1991 | Crompton | 273/336 |
| 5,303,931 | 4/1994 | Brown | 273/348 |
| 5,340,347 | 8/1994 | Yenerich | 446/48 |
| 5,366,403 | 11/1994 | Weiss | 446/46 |
| 5,531,624 | 7/1996 | Dunipace | 446/46 |
| 5,676,581 | 10/1997 | Zieglerll | 446/46 |

*Primary Examiner*—Sam Rimell
*Attorney, Agent, or Firm*—Swidler Berlin Shereff Friedman LLP

[57] ABSTRACT

The portable game apparatus includes a plurality of removable pegs, a planar game board that possesses a plurality of holes in a predetermined pattern and at least one annular plastic disk that has an inner edge, and an outer edge, a planar portion, and a rim whereby the plane is angled so that the inner edge is substantially higher than the outer edge of the disk.

The disk toss game involves throwing the disk toward the game board with the object of encircling one of the pegs. The length of the toss can be carried from 30 to 100+ feet depending on the talent of the competitors. The disk is aerodynamically shaped so that when it is tossed, it will become buoyant or airborne, thus enabling competitors of various physical attributes to become adapt at developing their skills at several distances. However, competitive standards will be developed. The game can be easily transported and played in any terrain or season of the year. The shape of the disk is such that it will be very safe if it should come in contact with a person while being tossed.

18 Claims, 7 Drawing Sheets

DISK TOSS AND PEG GAME

TECHNICAL FIELD OF THE INVENTION

This invention relates to games used for amusement purposes; more particularly, the present invention relates to a portable disk and toss game.

BACKGROUND

Universally, there is a need in the market place for new amusing portable games for people to play. There is a demand for challenging games that involve athletic skill and may be played by all age groups. The present invention provides a novel amusement device that is aimed at satisfying the publics desire for challenging games that are portable.

One piece of prior art in this area is the game of horseshoes. This game involves throwing metal horseshoes toward a stake located in the ground at a predetermined distance from a player. The object of horseshoes is to encircle the peg with the horseshoe. The disadvantages of this game are: 1) the metal horseshoe is dangerous for children to play with because a child may be seriously injured if hit with a horseshoe, 2) the overall weight of the horseshoe game may be considerable and this makes the game less transportable, 3) the horseshoes will sink if the horseshoe is accidentally tossed into a nearby lake or ocean, and 4) the horseshoe gate does not meet many players desire for novelty.

Both rings and FRISBEES are also prior art in this area. However, rings will not become airborne or stay aloft. Also, it takes more strength or athletic ability to throw any distance with accuracy. Also, the FRISBEE is too light for accuracy and can be moved easily by air currents.

Overall, there is a need for a new, athletic game that may be played by all age groups and may be portable. The typical family desired a game that is safe for their children to play but is also challenging for adults. Further, they want a lightweight, compact game that may be transported easily to the beach, the lake or any other place. Thus the present invention seeks to fill that void by offering a novel game that is athletically entertaining.

SUMMARY

The present invention relates to athletic recreational games. The invention includes a plurality of removable pegs that are located in a planar game board and a plurality of annular disks. The disks have an inner edge, an outer edge, and a planar portion, whereby the plane is angled so that the inner radius is higher than the outer radius of the disk. Also the rim of the disk is shaped considering safety factors and "gripability".

An object of the invention is to provide a durable, lightweight, compact game.

Another object of the invention is to provide a safe throwing object that may be played by children.

Another object of the invention is to provide a disk that has the ability to stay aloft but can still descend more accurately due to a funnel action.

Yet another object of the invention is to provide a throwing object that has both unique buoyant qualities and still maintain the accuracy.

Yet another object of the invention is to provide a disk that may be thrown a long distance because of gliding qualities but still be accurate.

Another object of the present invention is to provide an easily griped disk and a disk design that allows for new challenging throwing techniques.

DETAILED DESCRIPTION OF THE INVENTION

Game Board

Figure 4:
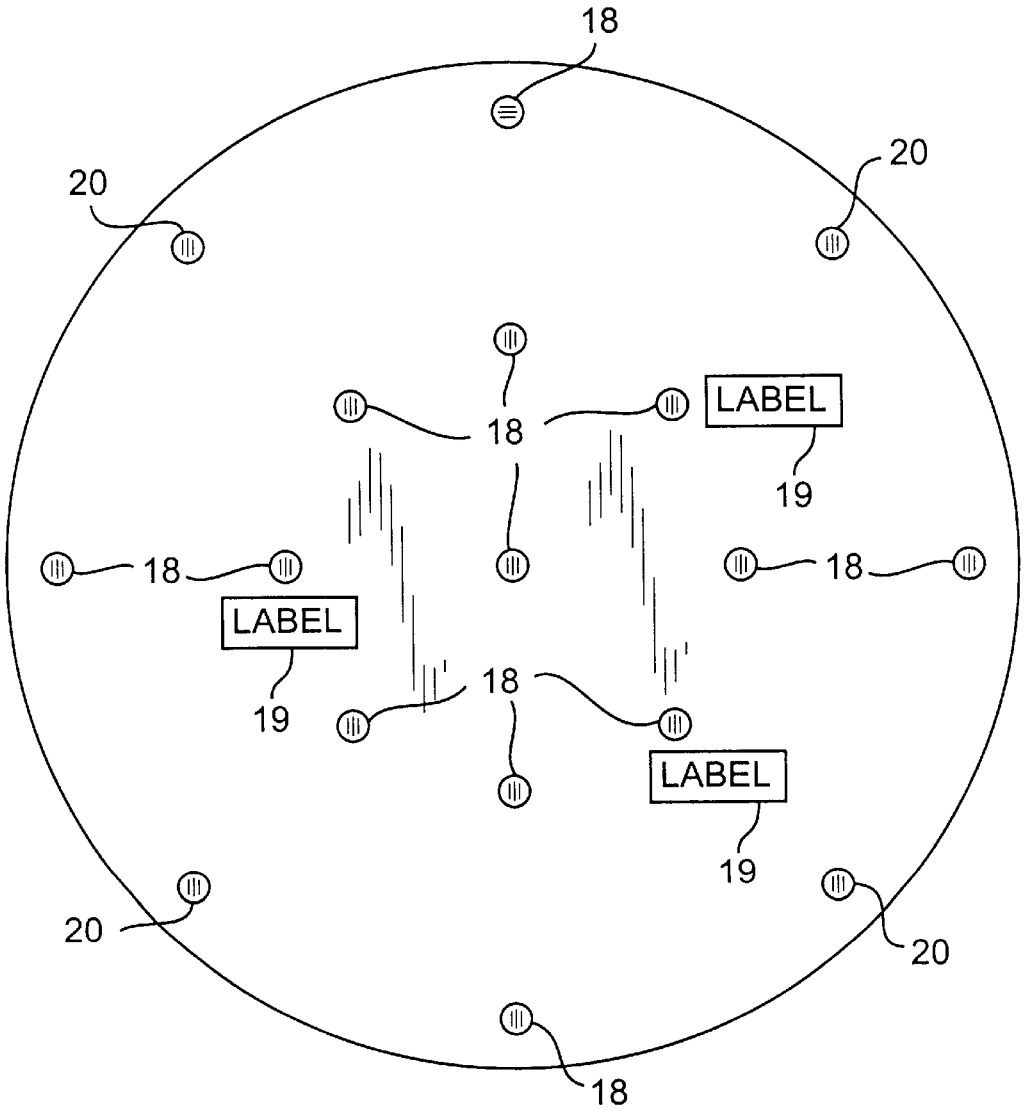
FIG. 4 is a top view of the game board.
Figure 5:
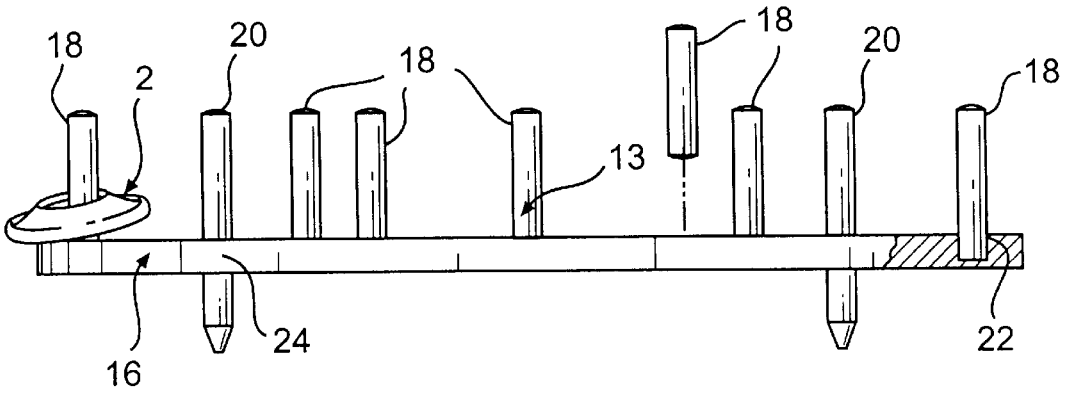
FIG. 5 is a side view of the game board. The figure provides a disk around one of the removable pegs.
Figure 6:
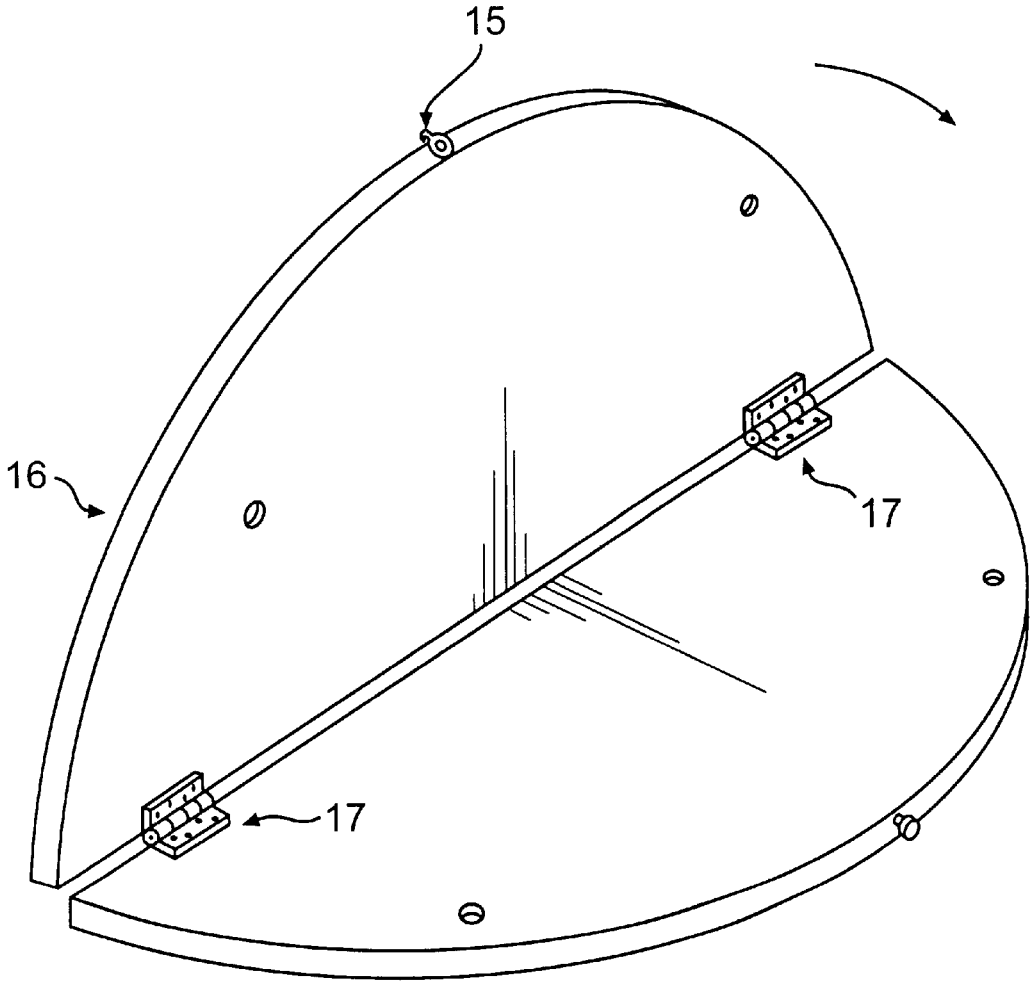
FIG. 6 is a perspective view of another embodiment of game board. The game board is foldable in FIG. 6.

Referring to FIGS. 4 and 5, a preferred embodiment of the game board 16 is a large circular plane. The diameter of the game board 16 is preferably 4 feet but may be as large as 6 feet. The thickness of the game board 16 is approximately ½" to 2".

The surface of the game board 16 is planar. The plane 10 of the game board 16 contains a plurality of holes 22 in a predetermined pattern. These holes 22 are roughly ½" in diameter but may be as large as 1½" wide. The holes 22 are circular or square and may extend entirely through the game board 16. In a preferred embodiment, holes 22 extend roughly 75 percent through the thickness of the game board. The holes 22 may have grooves that allow the pegs to be screwed into the holes. The holes 22 could also be tapered so that pegs may be snapped into place. Labels 19 are located next to the holes 22 and correspond to various games in the instructions. Those labels 19 may be pasted, painted or engraved into the board 16.

The holes 22 may be located in a predetermined pattern forming two circles and a center hole. The circles would be concentric and each circle would be made up of eight holes. The center hole would be located in the very center of the game board 16. Thus, a preferred embodiment of the game board 16 has seventeen holes 22, 24 so that the various games described subsequently may all be played on the game board.

The game board 16 may have approximately four holes 24 located near the edge of the board that extend all the way through the board's 16 thickness. The four holes 24 will be spaced equally apart along the edge of the game board 16.

In the preferred embodiment, the game board 16 is made out of a lightweight plastic material. One example of a suitable material would be an aerated plastic; an aerated plastic would be lightweight and still have the sufficient strength to maintain the form. Any material chosen for the board must have several qualities:(a) the material must be durable; (b) the material must be strong; and (c) the material must be light weight. Other factors should be considered when choosing the manufacturing material for the game board. These factors are not requirements but provide a better game board design. These factors include using a material that is waterproof or water resistant so that the game board will not be damaged by water. Also, the chosen material should be resistant to indentations. For example, a deformable material would not be suitable for the game board because the board could be dented by the disks. The game board 16 should be colored an attractive color which will appeal to the players. However, the color should contrast to that of the pegs and the disks, so that each specific element of the game can be easily distinguished.

In one embodiment, the game board 16 is foldable. In other words, the game board 16 has a crease or hinge 17 in the center 13 of the circle so that a player may fold the game board for carrying purposes. The game board 16 may be two pieces with hinges 17 connecting the two pieces to form the circle.

Also note that one embodiment of the game board 16 contains a hinge 17 which locks the game board 16 into two positions. The first position is one which locks the board so that the two halves of the game board 16 are locked into a circle. The lock prevents wind or other elements from pushing up the side of the game board 16 while playing. The second position of the hinge 17 locks the game board into the folded position so that it can be easily carried.

In another embodiment, a lock 15 would be placed on the edge of the game board 16 so that the two sides can be locked together when it is carried.

On the non-playing side of the board, the game instructions would be attached. These game instructions may be placed on a label, painted, or engraved on the non-playing side of the game board.

Pegs

The pegs 18 of the invention are generally cylindrical in shape and are removable. The pegs 18 are approximately 3"–12" in length, and ½" to 1½" in diameter. The pegs 18 may be constructed from any of the following materials: plastic, wood or metal. Approximately 20–30 pegs will be required. The cylindrical shape of the pegs 18 may be modified for decorative purposes. The diameter or width of the peg 18 should be no greater than 1½".

The peg 18 shape must correspond to the hole 22 shape in the game board 16 described above. Therefore, if the peg shape is modified for decorative purposes or other reasons, the receptacle hole 22 in the game board must be modified to accommodate the peg shape. Note that the peg 18 may have grooves at the end or may be tapered so that it will fit into a corresponding groove or tapered hole 22 in the game board.

In the preferred embodiment, four of the pegs 20 will be approximately 4" longer than the rest of the plurality. These extended pegs 20 will be referred to as stakes. These stakes 20 will correspond to four holes 22 in the peg board that are located on the edges of the peg board. The four stakes 20 will have a pointed edge on one side. Thus, these stakes 20 will have the same overall shape and size as the pegs except for the fact that one side of the stake 20 will be pointed and the stake 20 will be longer. The purpose of these stakes 20 are to stake the game board 16 to the ground and prevent the game board from being shifted during game play or adverse weather conditions. Note that these pegs 20 are also adapted to accept the disk described later.

Figure 8:
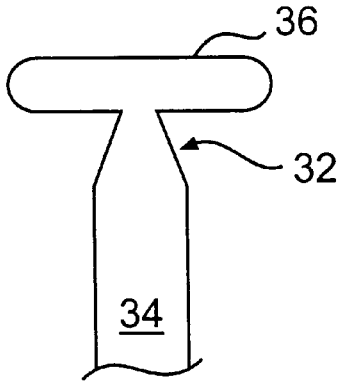
FIG. 8 is a cross sectional view of a removable peg.

Referring to FIG. 8, another embodiment of the invention provides pegs 34 that have indentations 32 near the tip 36 of the pegs. These indentations are located ½" from the tip 36 of the pegs 34 and encircle the perimeter of the pegs 34. These pegs are adapted to hook the disk with the hooked rim that is described hereafter.

The Disk

Figure 3:
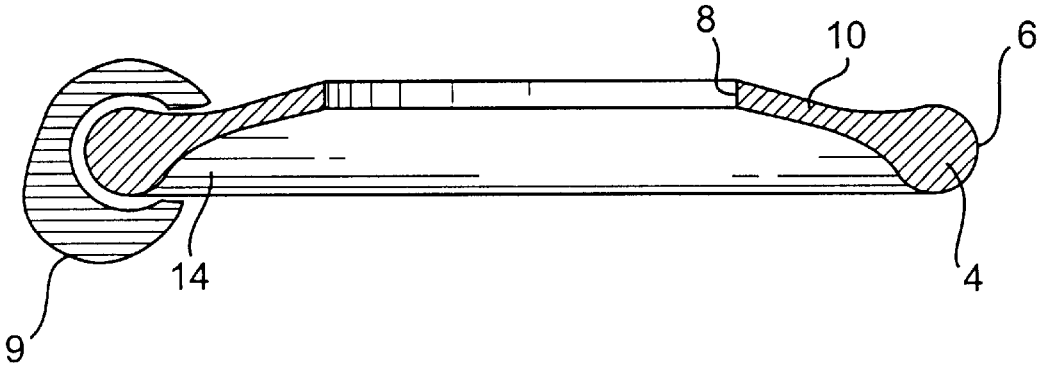
FIG. 3 shows a cross sectional view of the disk.

Generally, the disk 2 is a planar torroid in shape. The disk 2 has an inner radius and an outer radius; each radius is measured from the center 12 of the disk. The inner radius is measured to the inner edge 8 of the disk, and the other radius is measured to the outer edge 6 of the disk. Between the inner and outer radius, the disk 2 has an angled plane 10. The plane 10 of the disk is angled such that the inner edge 8 of the disk 2 is higher than the outer edge 6 of the disk when viewing the disk 2 from the side as shown in FIG. 3.

Figure 1:
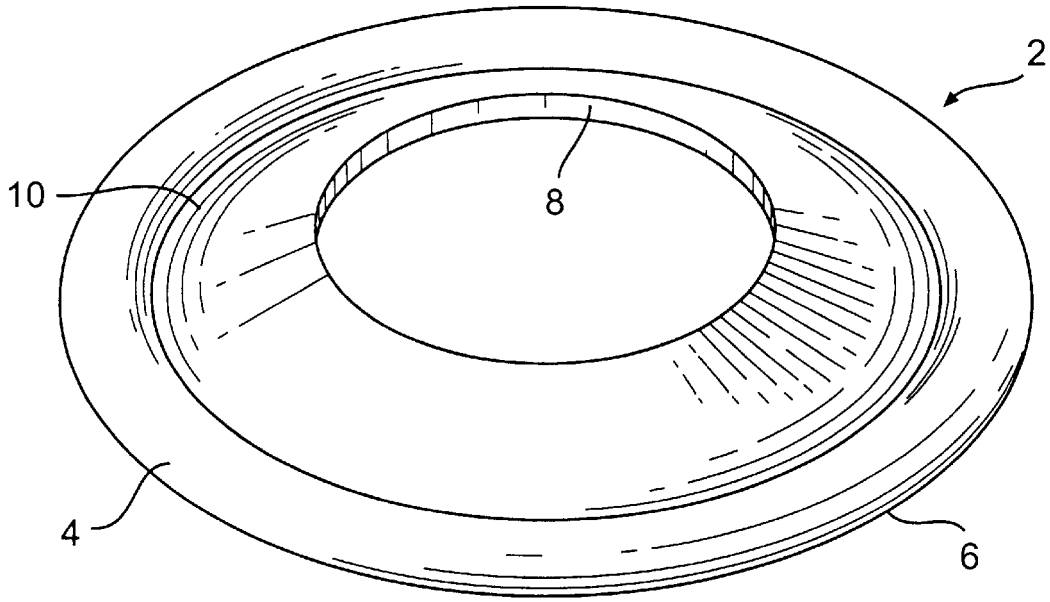
FIG. 1 is a perspective view of the disk.
Figure 2:
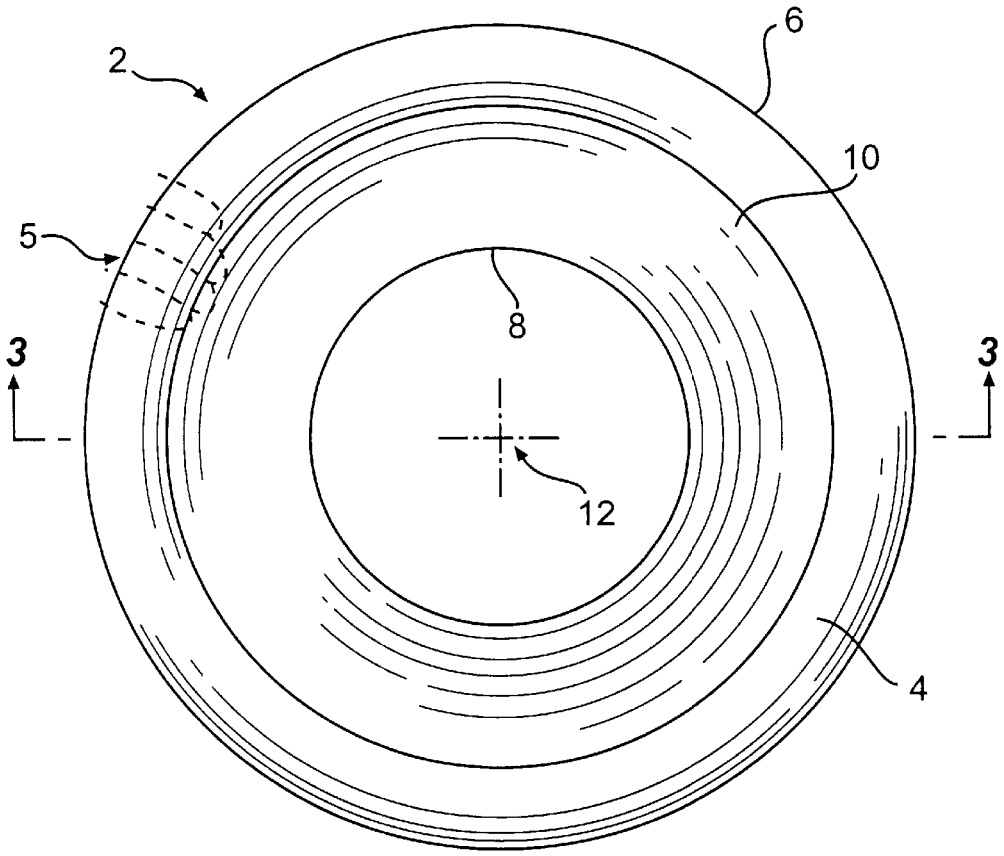
FIG. 2 shows a top view of the disk.

The top view of the disk 2 in FIG. 2 shows that the disk 2 has a circular shape and a circular hole in the center. The overall diameter of the disk 2 is between 8" and 16". A preferred embodiment of the disk 2 has a diameter of 10½" to 11". The overall diameter of the disk 2 should be determined such that the disk 2 can fit neatly between the pegs 18 on the game board. The size of the inner radius is roughly 2" to 4" for a 4" to 8" in diameter). The size of the inner radius should allow air to flow through the center of the disk 2.

The overall thickness of the plane 10 of the disk 2 should be between ⅛" and ½". The disk 2 may be thinner than ⅛" but, the fabrication material must be strong enough to allow for the thinness. The thickness of the disk 2 should not be greater than an ½" because the disk 2 would no longer have buoyant qualities.

A preferred embodiment of the disk 2 has a 15° angle 14. The angle 14 may be as small as 5° or as large as 40°. The angle 14 of the plane 10 may vary, but it should be based on the amount of lift the designer wants to give the disk 2. In other words, the angle 14 of the disk 2 should be determined so that the disk 2 may float through the air in a FRISBEE-like manner but still possess a predictable trajectory. The angle 14 and inner radius should be coordinated together so that the appropriate amount of lift is given to the disk 2. The inner hole of the disk 2 allows air to pass through the disk 2 so that the disk 2 becomes a hybrid between a FRISBEE and a ring.

The outer rim 4 of the disk 2 has several unique qualities. The cross sectional view shows that the rim 4 is circular in shape. The rim 4 may be up to 2" in diameter; the preferred diameter is ½" to ¾". This diameter should be based upon an average player's grip. In other words, the diameter should not be larger than would be easily gripped by an average player.

One embodiment of the disk 2 has a hollow rim 4. Having a hollow rim 4 will conserve plastic, make the disk 2 more light weight and allow for other aerodynamic capabilities. Note that weights 9 may be added to the rim 4 of the disk in different arrangements to provide the disk 2 with unique aerodynamic qualities. For example, plastic clips that are weighted may be clipped onto the rim 4 of the disk 2 at different intervals along the rim 4.

Figure 7:
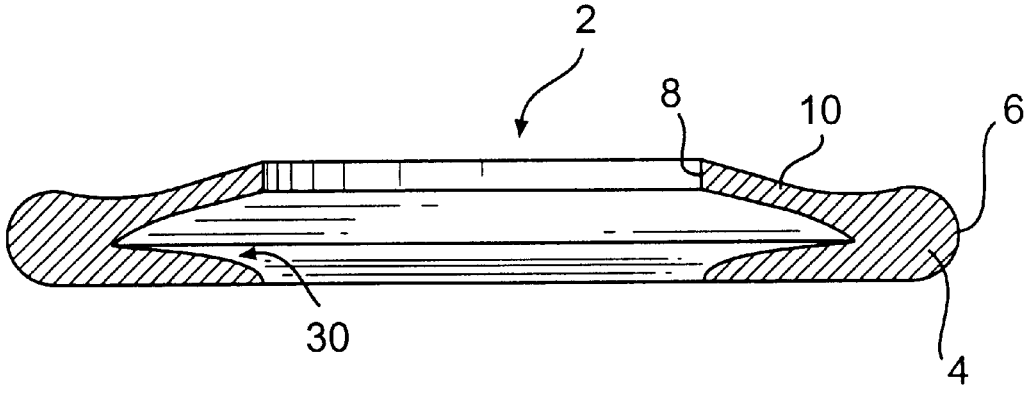
FIG. 7 is a cross sectional view of another embodiment of the disk.

Referring to FIG. 7, another embodiment of the invention, shows a disk with a hook-like rim 30 that is adapted to catch on the tips 36 of the indented pegs 34. Thus, when the disk is tossed toward the pegs on the game board, the hook-like rim 30 may catch on the indented pegs 34. This creates a new aspect of the game.

In another embodiment of the invention, the rim 4 contains grips 5 designed to fit the human hand. The disk 2 could have small indentations so that fingers may fit into the indentations. The cross-section of the rim 4 of the disk 2 may be a circle or an oval. Basically, any non-angular shape would be appropriate. The rim's 4 shape should be such that, to prevent injury, it does not have any sharp edges. The shape of the rim 4 should be designed considering safety and the grip size of the players.

The dimensions of the disk 2 may vary depending on factors such as portability, conservation of plastic materials and optimizing the aerodynamics. For example: (a) the rim's 4 diameter must be easily held by the average person; (b) the thickness of the disk 2 should be adjusted so that the disk 2 is lightweight; (c) the thickness of the disk 2 should be adjusted according to the strength and weight of the fabrication material; (d) the angle 14 of the disk should be adjusted according to the lift of the disk 2; (e) the inner radius of the disk must be large enough to accommodate a peg 18; and (f) the inner radius must be adjusted with reference to the outer radius so that there is enough of a plane 10 for air to hold the disk in the air.

The disk 2 should be made of a strong light weight plastic. The material must be strong enough to hold the shape of the disk 2, and not break, bend or be easily deformed from shape. The material used to form the disk 2 must also be lightweight so that it may be portable and float through the air.

Ideally, the disk 2 should be made of a buoyant material so that the disk 2 would float in a body of water, such as a lake or ocean. Alternatively, the fabrication material of the disk 2 should be water resistant so that it will not be damaged by water. The disk 2 should be colored a bright color so that the disk 2 may easily be found and is attractive to the player.

Games

The game may be played by one or more players. The game board should be located on a fairly flat surface. If suitable, the four stakes 20 should stake the game board 16 to the ground. The plurality of pegs 18 should be placed in the holes so that the pegs 18 extend roughly perpendicular to the board 16. The base of each peg 18 should be put as far down into the hole 20 so that the peg 18 does not fall out of the game board 16. Each of the players should stand approximately 30 to 100 feet away from the board, but still be in viewing distance of the board 16.

The player should take at least one of the disks 2 in hand and hold the disk 2 by the outside rim 4. The most basic principle of each of the games is to throw the disk 2 toward the game board 16 and pegs 18 with the object of encircling one of the pegs 18 with the disk 2. The throwing of the disk 2 can be easily mastered with some practice and can be varied depending on each individual's preference. However, accuracy can be better controlled by using a single step forward similar to a bowling toss. The disk 2 can be thrown with an arm swing like a pendulum holding the disk 2 either vertical to the ground and then switching to a horizontal position with a clockwise spin at the end of the swing, or the swing can be started with the arm holding the disk 2 horizontal to the ground to start and then swing the arm forward ending with a clockwise spin. This type of throwing enables almost any player of difference physical attributes to participate in the game. The disk 2 may be thrown in other ways including a tossing method. Each of the throws should be aimed toward the game board with the object of landing the disk 2 on the board with the one peg through the inner hole of the disk 2. The following descriptions provide several games:

Game "31"

In "31", each player throws two disks 2 with the object of encircling a peg 18 which has a label of a one, a three or a five. Each player throws the disk 2 with the object of having the disk 2 land on one of the pegs 18 so that the disk encircles the peg. The player is awarded the number of points that are on the label next to the peg 18. The overall objective of the game is to reach 31 points. If the player exceeds the value of 31, then the player's score reverts back to the previous score before the player exceeded the 31 value. Each time the player throws another disk 2 and the disk lands around a peg 18, the value of that peg 18 is added to the player's overall score.

Game "41"

In the game "41", the players in teams throw two disks 2 or 4 discs as individuals toward the pegs. Each of the pegs 18 has different values. The center peg 18 has a value of 3 points, the outside pegs 18 have a value of 2 point and 1 point is given to a disk landing at rest entirely on the board and not circling a peg.

The object of the game is to eliminate your points and reach zero. This is done by scoring a higher point value or by being on the board closer to the center peg 18. Each player or team should start out with the value of 41, and the scores are decreased as the play continues. Each turn, the score is decreased by the value that corresponds to the peg that is circled. If neither player places a disk 2 around a peg 18, then, the player places a disk 2 on the board closest to the center will be accorded the point. This point subtracted from the player or team's score. If neither player places the disk 2 on the board or around peg 18, then no points shall be awarded.

Game "Rotation"

The object of "Rotation" is to encircle the pegs 18 on the board in a rotating manner. Thus, each player has two disks 2 to throw in turn. In rotation, the pegs 18 around the outer edge 6 of the game are numbered in increasing order. The player throws a disk 2 toward the number one peg. After a player circles the number one peg, the next object is to circle the number two peg. Each player takes turns, and the first player to reach the end of the circle wins the game.

Game "Elimination"

The next game is called "Elimination". Each player or team throws two disks 2 at a peg 18, and when a peg 18 is encircled, it is pulled off the board until all the pegs 18 have been eliminated. The first player or team to eliminate all of the pegs 18 that correspond to the player or the player's team wins the game.

Game "21"

The game "21" has a pattern where only one peg 18 is placed in the center 13 of the board 16. The peg 18 has 3 points. Each player takes turns and throws the disk 2 toward the game board 16 at the peg 18 with the object of encircling the peg 18. If a player encircles the peg 18, then he is awarded three points. But if no player encircles the peg, then the player that is closest to the peg is accorded 1 point. Topping opponents encircled peg eliminates the opponents score and double topping gives the player 3 points. The object of the game is to be the first player that has 21 points.

While advantageous embodiments have been chosen to illustrate the invention, it will be understood by those skilled in the art that various changes and modifications can be made therein without departing from the scope of the invention as defined in the appended claims.

What is claimed is:

1. A portable game apparatus comprising:

a plurality of removable pegs, wherein each peg has a width less than 2";

a planar game board having a plurality of holes, wherein each hole is adapted to accept at least one of the pegs, and the holes are located in a predetermined pattern; and at least one annular shaped plastic disk having an inner edge, an outer edge, a planar portion, and a rim, the plane is angled so that the inner edge is substantially higher than the outer edge of the disk, the rim is non-angular and the disk is adapted to encircle at least one of the pegs.

2. A portable game apparatus according to claim 1 wherein at least two of the pegs have a pointed edge and are adapted to stake the game board into the ground.

3. A portable game apparatus according to claim 1 wherein at least one of the pegs has an indented tip, and at least one disk has a hook-like rim that is adapted to hook onto the indented tip.

4. A portable game apparatus according to claim 1 wherein the pegs are cylindrical in shape.

5. A portable game apparatus according to claim 1 wherein the pegs are plastic.

6. A portable game apparatus according to claim 1 wherein the pegs are between 3" and 2" in length.

7. A portable game apparatus according to claim 1 wherein the game board is foldable.

8. A portable game apparatus according to claim 1 wherein the game board is less than 6' wide.

9. A portable game apparatus comprising:

seventeen cylindrical plastic removable pegs wherein each of the pegs has a length between 3" and 12" in length and each of the pegs has a diameter between ½" to 1½";

a planar plastic game board wherein the game board is circular in shape, possesses seventeen holes where each hole is adapted to accept at least one peg, and each of the holes has a label; and a plurality of annular plastic disks where each disk has an inner radius, an outer radius, a planar portion, and a rim whereby the plane is angled so that the inner radius is higher than the outer radius of the disk, the inner radius is larger that the diameter of the peg so that the disk may encircle at least one peg, and the plane is at least 2" wide.

10. A portable game apparatus according to claim 9 wherein at least two of the pegs have a pointed edge and are adapted to stake the game board into the ground.

11. A portable game apparatus according to claim 9 wherein the game board is foldable.

12. A portable game apparatus according to claim 11 wherein the game board contains a lock on the edge of the game board to lock the game board into the foldable position.

13. A portable game apparatus according to claim 11 wherein the game board that is foldable has a hinge to make the board foldable, and the hinge has two position whereby a first position locks the board into a planar position and a second position locks the board into a folded position.

14. A portable game apparatus comprising:

a plurality of cylindrical plastic removable pegs wherein each peg has a length between 3" and 16", each peg has a diameter between ½" to 1½" and at least two of the pegs are adapted to stake the board into the ground;

a planar game board wherein the game board is circular, has a diameter between 4' and 6', possesses a plurality of holes adapted to accept at least one peg, has a lock to hold the board in the folded position, and has a hinge that will hold the board into the planar position; and at least two annular plastic disk that have an inner edge, and an outer edge, a planar portion at least 2" wide, and a rim whereby the plane is angled at least by 15 degrees so that the inner edge is substantially higher than the outer edge of the disk, the rim is substantially circular and the disk is adapted to encircle at least one of the pegs.

15. A method of playing a game:

(a) providing at least one player with an annular plastic disk that has an inner edge, and an outer edge, a planar portion, and a rim whereby the plane is angled to that the inner edge is substantially higher than the outer edge of the disk, the inner and the rim is non-angular;

(b) positioning a portable planar game board wherein the game board is circular, possesses a plurality of holes located in a predetermined pattern, at a predetermined distance from at least one of the players;

(c) positioning a plurality of pegs in the plurality of holes;

(c) commencing play by having at least one of the players throw the disk toward the game board; and (d) awarding points to the player if the disk lands on the game board.

16. A method of playing a game according to claim 15 further comprising awarding points if the disk encircles one of the pegs.

17. A portable game apparatus according to claim 1 further comprising at least one detachable weight whereby the weight changes the aerodynamic qualities of the disk.

18. A portable game apparatus according to claim 1 whereby the rim of the disk includes a grip that is designed to fit the human hand.

* * * * *